United States Patent [19]

Miyamoto

[11] Patent Number: 4,583,305

[45] Date of Patent: Apr. 22, 1986

[54] SKI BOOT

[75] Inventor: Yoshiyuki Miyamoto, Nara, Japan

[73] Assignee: Nara Sports Co., Ltd., Nara, Japan

[21] Appl. No.: 711,218

[22] Filed: Mar. 13, 1985

[30] Foreign Application Priority Data

Dec. 26, 1984 [JP] Japan ..... 59-280168

[51] Int. Cl.[4] ..... A43B 5/04; A43B 7/14

[52] U.S. Cl. ..... 36/119; 36/93

[58] Field of Search ..... 36/117–121, 36/93, 88, 71

[56] References Cited

FOREIGN PATENT DOCUMENTS

| | | | |
|---|---|---|---|
| 2162619 | 6/1973 | Fed. Rep. of Germany | 36/93 |
| 2456612 | 6/1975 | Fed. Rep. of Germany | 36/93 |
| 2845824 | 5/1979 | Fed. Rep. of Germany | 36/93 |
| 2496423 | 6/1982 | France | 36/119 |
| 525766 | 9/1972 | Switzerland | 36/93 |

*Primary Examiner*—James Kee Chi

*Attorney, Agent, or Firm*—Wenderoth, Lind & Ponack

[57] ABSTRACT

A ski boot provided with an air pack and a device for controlling the fastening force applied by the air pack on a skier's foot. It has an air pump connected to the air pack through a valve, a pressure sensor for sensing the air pressure in the air pack, a drive for the air pump, and a control circuit operative in response to the signal from the pressure sensor for controlling the valve and the drive for the air pump. A skier can adjust the fastening force easily to a desired value.

5 Claims, 2 Drawing Figures

SKI BOOT

BRIEF SUMMARY OF THE INVENTION

The present invention relates to a ski boot provided with a device for adjusting the fastening force.

Various types of fasteners for fitting the skier's foot to a ski boot are known. They use a buckle, a wire, an air pack, or a plastic plate, or combinations thereof.

The ambient temperature at a skiing surface and the temperature of the foot of a skier change moment by moment while a person is skiing. As they change, the physical properties of the materials of which the ski boot is made (e.g. resin of the outer shell and foam plastic of the inner boot) change. Thus, the fastening force, too, changes.

On the other hand, a human foot changes in size in a day. It is usually the smallest in size in the morning and tends to expand toward night. For these reasons, a skier has to continually adjust the fastening force or pressure of the ski boots on his feet. However, a skier had to adjust it resorting only to his feeling or sense. A quantitative adjustment of the fastening pressure was impossible. It could not be easily and quickly adjusted to a desirable pressure.

An object of the present invention is to provide a ski boot provided with a device for quantitatively controlling the fastening pressure on the skier's foot.

In accordance with the present invention, there is provided a ski boot comprising: an outer shell; an inner boot; an air pack disposed between the outer shell and the inner boot for fastening the skier's foot with the air contained therein; and means for quantitatively controlling the fastening pressure on the skier's foot; the means comprising an air pump connected through a valve to the air pack for supplying air into the air pack, a pressure sensor connected to the air pack for sensing the air pressure in the air pack and giving a signal, and a control circuit operative in response to the signal from the pressure sensor for controlling the valve and the air pump.

The pressure sensor detects the air pressure in the air pack and the electric air pump automatically supplies air into the air pack until the air pressure therein reaches a preset value.

In accordance with the present invention, a skier can obtain a desired fastening pressure extremely easily.

Other features and advantages of the present invention will become apparent from the following description taken with reference to the accompanying drawings, in which:

DETAILED DESCRIPTION OF THE INVENTION

Figure 1:
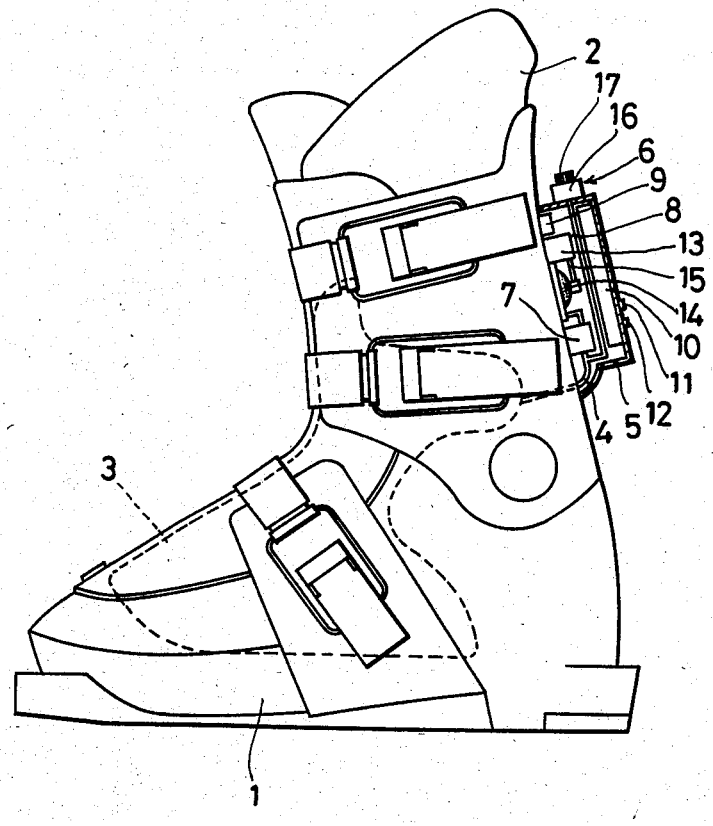
FIG. 1 is a partially cutaway side view of a ski boot embodying the present invention.

Referring to FIG. 1, a ski boot embodying the present invention comprises an outer shell 1 of a synthetic resin material, an inner boot 2 inserted in the outer shell, and an air pack 3 comprising a bag of a synthetic resin and material disposed between the outer shell 1 and the inner boot 2 at the front part of the ankle.

A pipe 4 has one end connected to the rear portion of the air pack 3. Its other end is connected through a solenoid valve 7 to an electric air pump 8 in a case 5 mounted on the back of the outer shell 1. A pressure sensor 6 is connected to the pipe 4 to sense the pressure in the air pack 3.

The case 5 contains a relay unit 9 for controlling the electric air pump 8 and the solenoid valve 7, and a power source 10 for the air pump 8. A suction switch 11 and an exhaust switch 12 are mounted on the case 5. The power source 10 may be a cell or a chargeable cell. An AC power source may be used through an adapter.

The electric air pump 8 comprises a motor 13 and a rubber pump 14. The motor 13 has a rotary shaft 15 connected to the pump 14 so as to butt it at an eccentric position. When the motor 13 is actuated, the rubber of the pump is caused to vibrate by the rotary shaft so that air will be supplied through the pipe 4 into the air pack 3. The pressure sensor 6 is provided with a sensor switch 16 and a pressure setting knob 17.

Figure 2:
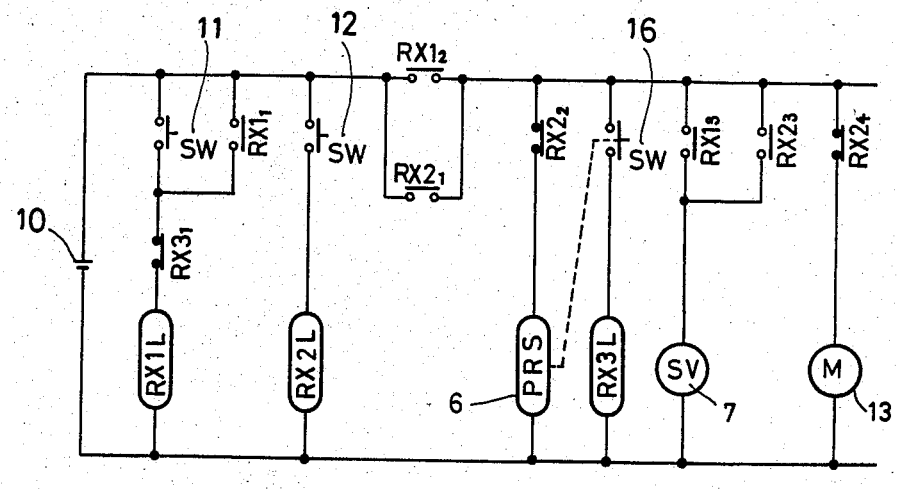
FIG. 2 is a circuit diagram of an example of a control circuit for the air pump and the solenoid valve.

Referring to FIG. 2, an example of a control circuit for the air pump 8 and the solenoid valve 7 will be described.

The control relay unit 9 has three relay coils RX1L, RX2L and RX3L. When the suction switch 11 is pressed, the relay coil RX1L will be energized, so that its contacts $RX1_1$, $RX1_2$ and $RX1_3$ will close. Thus, the relay coil RX1L will be kept energized so that the energizing coil of the solenoid valve 7 will be energized to open the solenoid valve. Simultaneously the motor 13 for the air pump 8 will be started to send air into the air pack 3.

When the air pressure in the air pack 3, sensed by the pressure sensor 6, reaches the value preset with the pressure setting knob 17, the pressure sensor switch 16 will close, energizing the relay coil RX3L. A-contact $RX3_1$ will open, deenergizing the relay coil RX1L, so that the contacts $RX1_2$ and $RX1_3$ will open and the solenoid valve 7 will close. Simultaneously the motor 13 for the air pump 8 will stop. Therefore, the air pressure in the air pack 3 will be equal to the preset pressure.

In order to deflate the air pack 3, the exhaust switch 12 is pressed. When it is pressed, the relay coil RX2L will be energized so that its contacts $RX2_2$ and $RX2_4$ will open and its contacts $RX2_1$ and $RX2_3$ will close. Therefore, with the power for the motor 13 off, the solenoid valve 7 will be opened by its energizing coil so that air will be discharged out of the air pack 3. When the exhaust switch 12 is released, the solenoid valve 7 will close.

THus, merely by pressing the suction switch 11, the pressure in the air pack 3 can be easily brought back to the preset value in any situation.

What I claim is:

1. A ski boot comprising:

and outer shell;

and inner boot;

an air pack disposed between said outer shell and said inner boot for fastening the skier's foot with the air contained therein; and means for automatically and quantitatively controlling the fastening pressure on the skier's foot by controlling the pressure in said air pack;

said means comprising an air pump means connected through a valve to said air pack for supplying air into said air pack, a pressure sensor means connected to said air pack for sensing the air pressure in said air pack and giving a signal when the pressure in said air pack is below a preset value, and a control circuit means operative in response to the signal from said pressure sensor means for automatically controlling said valve and said air pump means for maintaining the pressure in said air pack at said preset value.

2. The ski boot of claim 1 wherein said valve is an electric solenoid valve.

3. The ski boot of claim 1 wherein said air pump means includes an electric motor and a portable power source attached to said ski boot for driving said motor.

4. The ski boot of claim 1 wherein said control circuit means includes a suction switch for actuating said air pump and opening said valve when the pressure in said air pack is below said preset value.

5. The ski boot of claim 1 wherein said control circuit means includes an exhaust switch for turning off power to said air pump and opening said valve whereby pressure in said air pack may be released.

* * * * *